US005359842A

United States Patent [19]

Braxmeier et al.

[11] Patent Number: 5,359,842

[45] **Date of Patent: * Nov. 1, 1994**

[54] SPINNING OR TWISTING SHAFT BEARING ASSEMBLY WITH VIBRATION ISOLATION CONNECTION ARRANGEMENT

[75] Inventors: Hans Braxmeier, Süssen; Gerd Stahlecker, Eislingen, both of Germany

[73] Assignees: Fritz Stahlecker, Bad Ueberkingen; Hans Stahlecker, Suessen, both of Germany

[ * ] Notice: The portion of the term of this patent subsequent to Apr. 13, 2010 has been disclaimed.

[21] Appl. No.: 970,059

[22] Filed: Nov. 2, 1992

Related U.S. Application Data

[63] Continuation-in-part of Ser. No. 879,441, May 1, 1992, abandoned, which is a continuation of Ser. No. 606,724, Oct. 31, 1990, abandoned, and a continuation-in-part of Ser. No. 855,477, Mar. 23, 1992, Pat. No. 5,201,170, which is a continuation of Ser. No. 615,277, Nov. 19, 1990, abandoned, and a continuation-in-part of Ser. No. 691,808, Apr. 26, 1991, abandoned, and Ser. No. 672,078, Mar. 19, 1991, abandoned.

[30] Foreign Application Priority Data

| | | | |
|---|---|---|---|
| Nov. 17, 1989 | [DE] | Germany | 3938255 |
| Dec. 23, 1989 | [DE] | Germany | 3942912 |
| Mar. 27, 1990 | [DE] | Germany | 4009695 |
| Aug. 8, 1990 | [DE] | Germany | 4025130 |

[51] Int. Cl.[5] ..... D01H 7/08; D01H 7/14

[52] U.S. Cl. ..... 57/132; 57/134; 57/135

[58] Field of Search ..... 57/75, 130, 132, 133, 57/134, 135; 384/227, 228, 234, 237, 239, 240

[56] References Cited

U.S. PATENT DOCUMENTS

| | | | |
|---|---|---|---|
| 2,169,587 | 8/1939 | Magrath | 308/151 |
| 2,777,739 | 1/1957 | Beerli | 384/227 |
| 3,076,306 | 2/1963 | Wagner | 57/135 |
| 3,095,687 | 7/1963 | Beerli | 57/100 |
| 3,435,604 | 1/1967 | Shotbolt | 57/135 |
| 3,485,029 | 12/1969 | Beerli | 57/134 |
| 5,201,170 | 4/1993 | Stahlecker et al. | 384/237 X |

FOREIGN PATENT DOCUMENTS

| | | | |
|---|---|---|---|
| 558023 | 6/1957 | Belgium | 57/135 |
| 0209799 | 1/1987 | European Pat. Off. . | |
| 217980 | 10/1908 | Germany | 57/135 |
| 2749389 | 11/1980 | Germany . | |
| 3620497 | 11/1987 | Germany . | |

*Primary Examiner*—Daniel P. Stodola
*Assistant Examiner*—William Stryjewski
*Attorney, Agent, or Firm*—Evenson, McKeown, Edwards & Lenahan

[57] ABSTRACT

A spinning or twisting bearing assembly for supporting a spinning or twisting shaft is disclosed. The bearing assembly includes a spindle shaft neck bearing having roller bodies engageable with the spindle shaft at a first axial location above a step bearing assembly for supporting the bottom end of the spindle shaft. The neck bearing and step bearing assembly are disposed in a bearing housing. An outer housing is disposed to surround the bearing housing with an annular gap therebetween along a substantial length of the bearing housing. The outer housing is fixedly clamped to a spindle rail. In order to isolate sound causing vibrations from the roller bodies of the neck bearing, the bearing housing is clamped to the outer housing only at a position below the bearing housing. In use, vibrations from the roller bodies are then transmitted only indirectly to the spindle rail by way of the bearing housing, the connection of the bearing housing to the outer housing at the bottom of the bearing housing, and the out of the upper housing to the clamp bearing housing at the spindle rail.

20 Claims, 6 Drawing Sheets

SPINNING OR TWISTING SHAFT BEARING ASSEMBLY WITH VIBRATION ISOLATION CONNECTION ARRANGEMENT

This application is a continuation-in-part application of application Ser. No. 07/879,441, filed May 1, 1992 and now abandoned, which is a continuation of 07/606,724, filed Oct. 31, 1990 and now abandoned; and a continuation-in-part application of application Ser. No. 07/855,477, filed Mar. 23, 1992 and now U.S. Pat. No. 5,201,170, which is a continuation of 07/615,277, filed Nov. 19, 1990 and now abandoned; and a continuation-in-part application of application Ser. No. 07/691,808, filed Apr. 26, 1991 and now abandoned; and a continuation-in-part application of application Ser. No. 07/672,078, filed Mar. 19, 1991 now abandoned.

BACKGROUND AND SUMMARY OF THE INVENTION

The invention relates to a spinning or twisting spindle assembly having a spindle shaft which is rotatably supported inside a spindle bearing housing by means of a neck bearing and a step bearing assembly.

In use, a large number of similar spindle assemblies of the type contemplated by the invention are attached to spinning or twisting machine frame members (spindle rails) and are rotatably driven by a tangential belt. The tangential belt extends adjacent the spindle assemblies and drivingly engages driving wharves carried on respective spindle shafts of the spindle assemblies. It is not uncommon for several hundred common belt driven spindle assemblies to be provided at one side of a spinning or twisting machine.

Increasing rotational speeds of the spindle shafts, which are desirable in terms of increases in productivity, create increasing noise problems. It has been discovered that a significant source of these noise problems emanates from the roller bodies of the neck bearings which radially support the rotating spindle shaft at an axial position close to the belt driven wharve and axially spaced from the bottom end of the spindle shaft supported in the step bearing assembly at the bottom of the spindle bearing housing.

In conventional commercially available spindle assemblies, such as the Süssen spindle bearing HP-S 68, manufactured and marketed by the Süssen Group of Germany, the spindle bearing housing is inserted through an opening in a spindle rail member and is threadable clamped directly to the rail by a spindle flange assembly. It has been discovered that the vibrations generated at the roller bodies of the neck bearing in such prior art constructions are transmitted as structure-borne noise or vibrations by way of the spindle bearing housing which forms or is fixed to the outer bearing race of the neck bearing. These vibrations are transmitted directly to the spindle flange assembly and the spindle rail due to the direct clamping connection of the spindle bearing housing. These vibrations are converted into sound causing mechanical vibrations of the large-area machine elements, including the spindle rail and machine frame supports for the spindle rail. Thus, although spinning or twisting spindles and their bearings can be manufactured with increased precision by modern machinery and manufacturing methods, noise problems as discussed above become particularly troublesome starting at rotational speeds of 17,000 $min^{-1}$ (revolutions per minute).

In the case of a known spinning or twisting spindle of the initially mentioned type (EP-A 209 799), a holding device for the spindle bearing housing comprises a sleeve mounted on the spindle bearing housing in the area of the step bearing and a sleeve which is arranged at an axial distance to it, surrounds the spindle bearing housing at a distance and is used for the fastening to a spindle rail. A ring of axially extending flexible spring bars arranged at a uniform distance is provided between the two sleeves. As a result, it is to be achieved that the spindle bearing housing can be deflected only radially with respect to the spindle axis.

In order to reduce the running noises of spinning or twisting spindles, it is also known from German Patent Document DE-A 36 20 497 to mount the spindle bearing housing by means of rubber-elastic damping elements on a spindle rail. Although this achieves a reduction in the generating of noise, it is connected with other functional disadvantages. It is an important disadvantage that there is the risk that the rubber-elastic damping element, when it is loaded on one side, which occurs particularly in the case of a tangential-belt drive for the spindles, yields more and more as the time goes by so that the spindle will be skewed.

A spindle assembly of the initially mentioned type as it is known from the German Patent Document DE-C 27 49 389 also does not adequately solve the above-discussed noise problems. In this construction, a bearing housing is provided which accommodates a neck bearing and a complete step bearing (a radial bearing element as well as an axial bearing element) and thus holds the whole spindle also in the axial direction. In this construction, the bearing housing is mounted closely below the neck bearing on the upper end of an intermediate tube which surrounds the bearing housing at a distance in the remaining area. Below the step bearing, the intermediate tube is connected with its lower end by way of a connecting element with the lower end of an outer bearing housing which is provided with devices for the fastening to a spindle rail and which surrounds the intermediate tube at a distance. In one embodiment, the bottom part has a contraction in order to create an area that is spring-elastic when being bent. The spaces between the bearing housing and the intermediate tube, on the one hand, and between the intermediate tube and the outer bearing housing, on the other hand, are connected with one another by way of openings and are filled with oil, the level of which extends along half the height of the outer bearing housing. By means of this oil, vibrations of the spindle are to be damped so that the running quality of the spindle will be improved.

Measures for the reduction of noise are not provided in the case of this spindle assembly disclosed in German Patent Document DE-A 27 49 389. The existing contraction in the connecting element does not act as a point of discontinuity by means of which the structure-borne sound transmission is limited to a significant extent. The reason is that the space between the intermediate tube and the outer tube is filled with oil also in the area of the contraction so that a structure-borne noise transmission takes place by way of this oil.

It is an object of the invention to develop a spinning or twisting spindle assembly of the initially mentioned type such that a clear reduction of the noise problem is achieved.

This object is achieved according to preferred embodiments of the invention by providing an outer housing clamped directly to the spindle rail, a bearing housing disposed inside of and vibration isolated from the outer housing by way of an annular gap along the length of the bearing housing from a neck bearing to below a step bearing, and a vibration isolation connection of the outer housing and bearing housing at a position below the step bearing, whereby vibrations at the neck bearing are transmitted only indirectly to the spindle rail by way of downward transmission through the bearing housing to the vibration isolation connection and then upward through the outer housing back up to the spindle rail.

In certain preferred embodiments, the vibration isolation connection is a direct metallic connection. This direct metallic connection is preferably made by press fitting the bottom of the bearing housing into the bottom part of the outer housing. In alternative embodiments, a metallic connecting element is press fit into the bottom of the bearing housing and into the bottom part of the outer housing. A significant advantage of a direct metallic connection between the bearing housing and outer housing is that such direct metallic connection accommodates the transverse loading of the spindle shaft and bearing housing by the driving belt over long periods of time. Rubber elastic type connection are disadvantageous in that, over time, the transverse loading causes a change in the elastic characteristics so that the operation of the spindles over time may not remain reliable. That is, rubber elastic connections deteriorate over time while the metallic connections do not. The metallic connections still provide elastic flexibility due to their shape and materials as compared to the bearing housing and outer housing being connected.

In certain preferred embodiments of the invention, the vibration isolation connection includes a diminished cross-section of the bottom part of the bearing housing constructed as a discontinuity point which limits transmission of structure-borne noise and which, with respect to the flexural strength, in the case of a radial load at the neck bearing, has a spring rate of 70 N/mm to 300 N/mm. In certain preferred embodiments of the invention the space between the spindle bearing housing and the outer housing, which space is separated from the interior of the spindle bearing housing, a sound insulating medium is present, the sound velocity of which is preferably less than 500 m/s. Because of the discontinuity point, the structure-borne sound transmission is largely interrupted as early as inside the spindle bearing housing so that high-frequency vibrations which later become sound are transmitted only to a minor extent to the outer housing and from there to the spindle rail and other machine parts. The outer housing itself also causes a shielding of the sound emitted by the spindle bearing housing. In this case, it is also provided that no medium is present in the space between the spindle bearing housing and the outer housing which is capable of transmitting structure-borne sound to a significant degree. That is, the sound insulating medium is not a fluid like lubricating oil usually present inside the bearing housing, which lubricating oil would be capable of and would transmit structure-borne sound to a degree not intended by the present invention.

In especially preferred embodiments where sound insulating medium is filled into the space between the bearing housing and outer housing, the sound insulating medium is filled to a level at least two-thirds of the height of the spindle bearing housing and the sound insulating medium is viscous between 20° C. and 60° C.

In certain preferred embodiments of the invention, it is provided that the space between the spindle bearing housing and the outer housing is filled with a grease at least in the area of the discontinuity point. As a result, the generating of noise can be further reduced. A similar effect is obtained if the space between the spindle bearing housing and the outer housing is filled with an elastomer at least in the area of the discontinuity point.

In certain preferred embodiments of the invention, it is provided that the step bearing is divided into a radial bearing element and an axial bearing element and that the axial bearing element is supported in an axial direction with respect to a connecting element forming the vibration isolation connections. As a result, it is achieved that the spindle bearing housing in its tube-shaped area is not loaded by tensile forces or pressure forces but only by bending forces. This will result in more defined conditions also with respect to the discontinuity point.

The invention is first based on the recognition that the main cause of the running noises is the neck bearing which normally contains roller bodies engaging the spindle shaft. Even if the neck bearing has a high precision of shape and only a small play is maintained in the area of the neck bearing, small deviations of the running surface cannot be avoided due to the asymmetric transverse loading by the driving belt, which have the result that the roller bodies and thus also the spindle bearing housing are caused to perform vibrations. These vibrations are then, in a so-called flow of structure-borne sound, transmitted to other machine elements which have larger surfaces capable of vibrating and correspondingly increase the generating of noise. By means of the point of discontinuity formed by the vibration isolation connection of the bottom of the bearing housing to the outer housing, it is achieved that the flow of structure-borne sound is reduced significantly so that vibrations of the spindle bearing housing are transmitted to other machine elements and particularly the spindle rail only to a significantly reduced extent. The running noises are therefore essentially reduced to the spindle bearing housing as the source of noise. In addition, the outer housing which surrounds the spindle bearing housing at a distance acts as a shield against noise. In this manner, effective reduction of noise can be achieved without the requirement of providing rubber-elastic elements as holding devices between the spindle bearing housing and the spindle rail.

In certain preferred embodiments rubber elastic damping devices may be provided in addition between the bearing housing and outer housing, which bearing devices may therefore be designed exclusively for vibration damping without concern for holding the spindle in its position since that holding function is carried out by the vibration isolation connection of the bearing housing bottom part with the outer housing.

In certain preferred embodiments of the invention, it is provided that the connecting element has a material cross-section which differs from the material cross-section of the spindle bearing housing. This difference in the cross-section of the material inhibits the flow of the structure-borne sound. In this case, the inhibiting effect is the more pronounced, the larger the difference.

In certain preferred embodiments of the invention, it is provided that the vibration isolation connection includes a material, the modulus of elasticity of which differs from the modulus of elasticity of the material of the spindle bearing housing and/or the surrounding outer housing. This difference with respect to the modulus of elasticity of the two materials also results in a hindering of the flow of the structure-borne sound, the hindering also in this case being the higher, the larger the difference.

In certain preferred embodiments of the invention, it is provided that the vibration isolation connection includes a connecting element which is a spring element which is arranged as an axial extension of the spindle bearing housing and is essentially radially flexible with respect to the spindle axis. This spring element may act as a point of discontinuity in which case, on the one hand, in relationship to the spindle bearing housing, it may have a small material cross-section and, on the other hand, a clearly increased modulus of elasticity so that a particularly effective point of discontinuity is created.

In certain preferred embodiments of the invention, it is provided that the vibration isolation connection includes a connecting element in the form of a pin arranged as an axial extension of the spindle bearing housing which is connected with the spindle bearing housing and the surrounding housing and has a free length situated between the connecting points. A pin of this type, in a relatively simple manner, may be dimensioned such that it can reliably absorb the occurring forces while, on the other hand, it forms a very effective point of discontinuity.

In certain preferred embodiments of the invention, it is provided that the surrounding outer housing has a sleeve-type shape and is equipped with devices for the fastening to a spindle rail. In this embodiment, each spindle bearing housing is surrounded by its own housing.

In certain preferred embodiments of the invention, it is provided that several spindle bearing housings arranged in a row are housed inside a common housing. In an advantageous design of this further development, it is provided that the common housing is a spindle rail. As a result, the expenditures can be slightly reduced because a component which, as a rule, is present anyhow can also be used as the surrounding housing.

In certain preferred embodiments of the invention, the outer housing has a substantially greater axial moment of inertia than does the bearing housing. In especially preferred embodiments the axial moment of inertia of the outer housing is at least 10 times the axial moment of inertial of the spindle bearing housing.

Because of the ratio of the axial moments of inertia, vibrations of the spindle bearing housing are transmitted to the sleeve-type outer housing and by it to the spindle rail only to a significantly reduced extent. The ratio of the axial moments of inertia provides that the spindle bearing housing can virtually not excite the much stiffer sleeve-type outer housing to perform vibrations. The running noises are therefore essentially reduced to the running noises generated by the spindle bearing housing. In addition, because of its preferably relatively thick wall thickness, the sleeve-type outer housing acts as a shielding device. This results in a reduction of noise as well as in an insulating of noise.

In certain preferred embodiments of the invention, it is provided that the wall thickness of the sleeve-type outer housing amounts to at least four times the wall thickness of the spindle bearing housing. This results in a particularly good shielding. For the same purpose, it is advantageous if, according to another development of the invention, the sleeve-type outer housing extends at least along two thirds of the height of the spindle bearing housing.

In certain preferred embodiments of the invention, it is provided that the spindle bearing housing is equipped with a covering which reaches over the upper edge of the sleeve-type outer housing, preferably with play. As a result, a noise shielding is also obtained in the area of the upper edge of the ring gap between the spindle bearing housing and the sleeve-type housing.

In certain preferred embodiments of the invention, it is provided that the spindle bearing housing, beyond the step bearing, is lengthened in a tube shape and is held in this area by the sleeve-type outer housing. As a result, the possibilities of a vibration transmission between the spindle bearing housing and the sleeve-type outer housing can be further reduced. In addition, there is a simple shaping of the spindle bearing housing which, as a whole, consists of a tube-shaped body.

In certain preferred embodiments of the invention, it is provided that the area of the spindle bearing housing which receives the neck bearing outer race is constructed to be flexible in the radial direction. As a result, the area of the spindle shaft is reduced which may affect the spindle bearing housing in the area of the neck bearing. This also has an advantageous effect on the noise level.

Other objects, advantages and novel features of the present invention will become apparent from the following detailed description of the invention when considered in conjunction with the accompanying drawings.

DETAILED DESCRIPTION OF THE DRAWINGS

Figure 1:
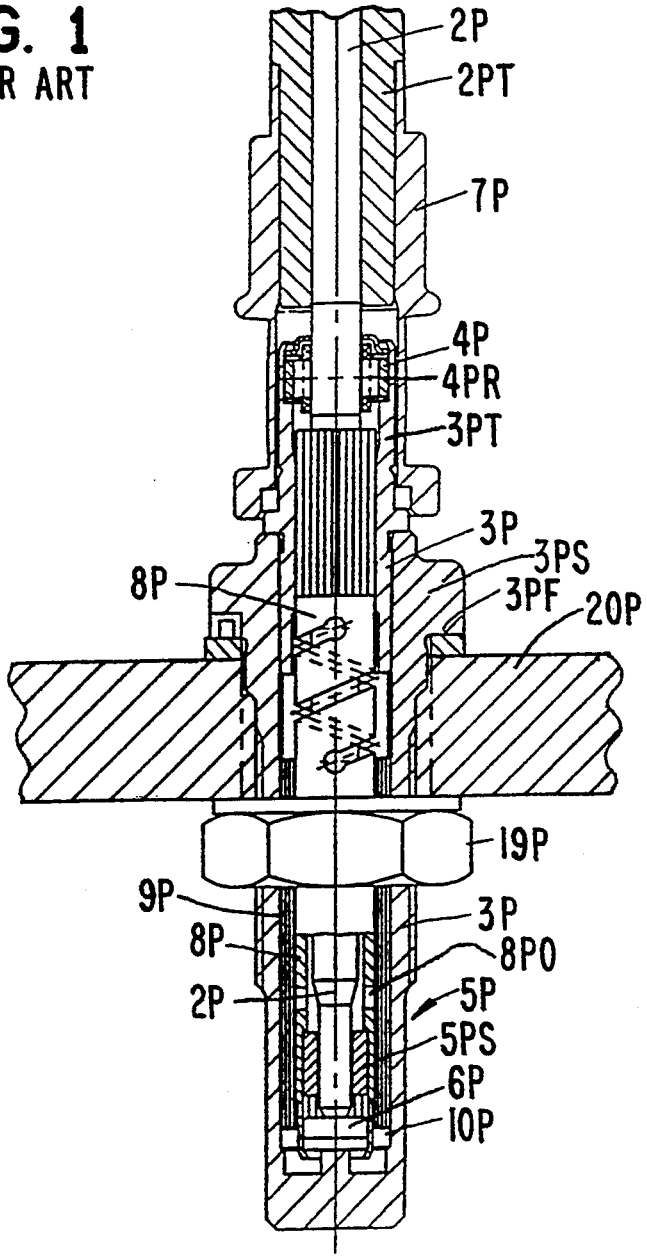
FIG. 1 PRIOR ART
FIG. 1 is a side, partially cut-away sectional view of a prior art spindle assembly.

The prior art spindle assembly of FIG. 1 corresponds to a commercially available spindle assembly made and sold by the Süssen Group in Germany under the model designation HP-S 68.

Referring to FIG. 1, the spinning or twisting spindle 1 comprises a spindle shaft 2P which is non-rotatably connected with the top part 2Pt of the spindle and which is disposed in a spindle bearing housing 3P by means of a neck bearing 4P and a step bearing assembly 5P. By way of wharve 7P, the shaft 2P is driven by a not shown tangential belt. The step bearing assembly 5P has a bearing sleeve 5PS held by means of a centering sleeve 8P. The centering sleeve 8P is radially held by means of a damping coil 9P which supports itself in the axial direction against a bottom plate 10P. Lubricating oil is communicated between centering sleeve 8P and the area of the damping coil 9P by way of openings 8PO.

The step bearing 5P also comprises a pivot bearing support plate 6P on which the end of the spindle shaft 2P is supported.

The neck bearing 4P is constructed as a roller bearing, the roller bodies 4PR of which run on the spindle shaft 2P and are guided on the outside by means of an outer ring or race fixed on the inside circumference of the top of spindle bearing housing 3P. Spindle bearing housing 3P includes a top part 3PT carrying the neck bearing race, which top part 3PT is press fit into bottom spindle bearing housing part 3PB

The spindle bearing housing 3P is clampingly fixed to spindle rail 20P by threaded clamping nut 19P acting together with the clamping flange 3PF of bearing housing part 3PB and with spacers or washers interposed. In practice the upper spacer can include a support plate for a pivotal securing hook (not shown) which prevents undesired upward axial movement of the spindle and shaft during operation and permits axial upward movement of the spindle and shaft when pivoted away. Due to the direct clamping of flange 3PF to spindle rail 20P, vibrations transmitted from the roller bodies of the neck bearings 4P are transmitted directly via the housing 3P to the spindle rail 20P via a metallic clamping connection. This direct connection results in undesirable noises caused by vibrations of the spindle rail 20P and associated machine frame parts, especially at high spindle speeds above 17,000 $min^{-1}$ (revolutions per minute).

Figure 2:
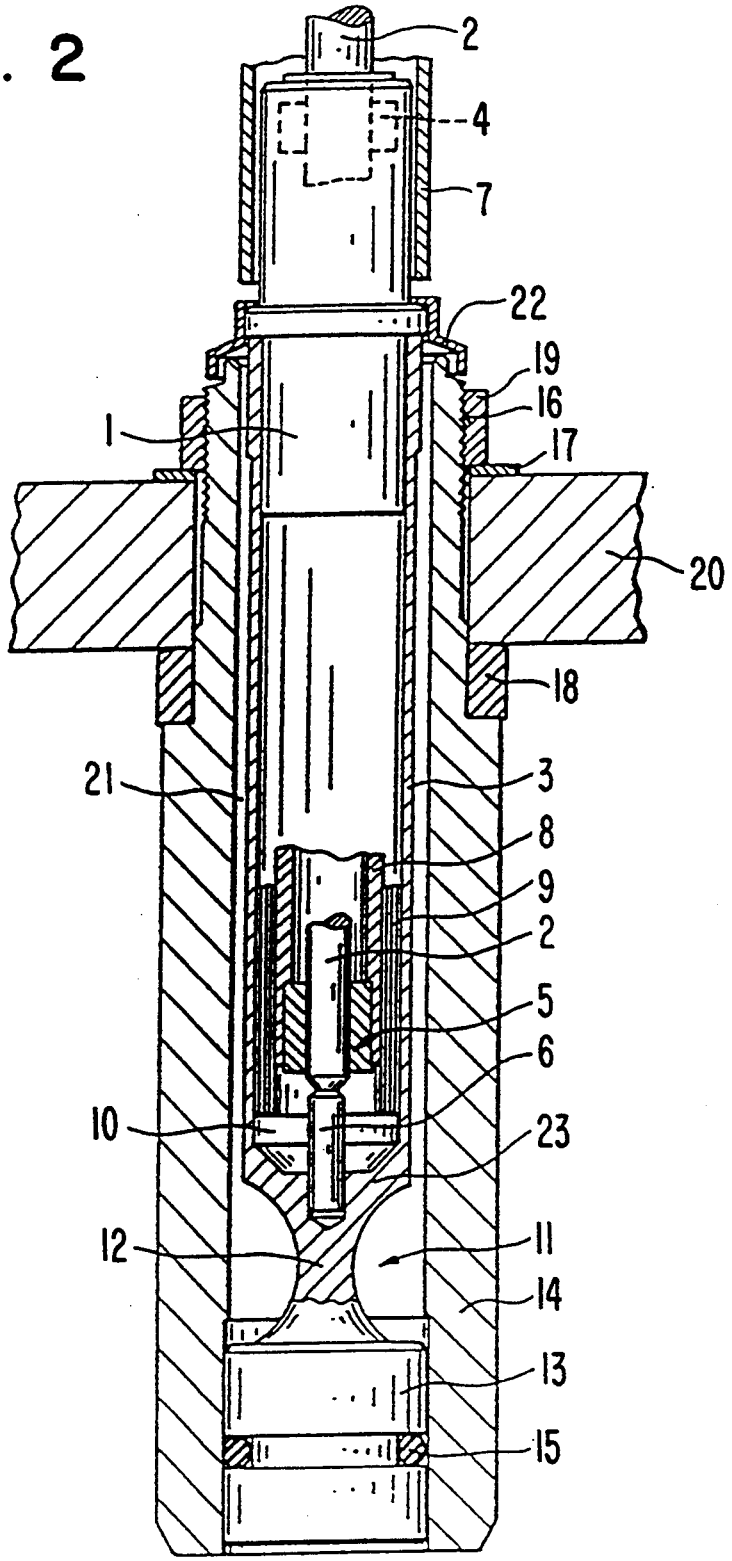
FIG. 2 is a side, partially cut-away sectional view of a spinning or twisting spindle which is fastened to a spindle rail by way of an outer housing surrounding the spindle bearing housing at a distance, constructed according to a preferred embodiment of the invention.

Referring to FIG. 2 which illustrates a preferred embodiment of the invention, the bearing housing 3, the neck bearing 4, the step bearing assembly 5, with centering sleeve 8 and damping coil 9, are constructed substantially similarly to correspondingly numbered parts (with suffix "P") of the prior art FIG. 1 arrangement. The invention of FIG. 2 differs markedly from the FIG. 1 prior art arrangement in that there is provided an outer housing 14 which surrounds and is axially spaced from bearing housing 3 along its axial length to thereby provide a non contact annular gap sound/vibration insulation between the bearing housing and outer housing. The bearing housing 3 is sealed or closed with respect to the annular gap between the bearing housing 3 and outer housing 14 so that lubricant oil from the bearing housing cannot serve to transmit vibrations between the housings.

The outer housing is connected to the bearing housing only by way of the below described connection located under the bearing housing and the outer housing is in turn connected directly to the spindle rail.

Referring to FIG. 2, the spindle bearing housing 3 is extended in the axial direction beyond its bottom 23 by means of a pin-type projection 12 which forms a contraction, that is, which has a much smaller cross-section than the spindle bearing housing 3. The pin-type projection 12 merges into a cylindrical widened continuation 13 which is pressed into a sleeve-type outer housing 14. A sealing ring 15 is provided in the area of this continuation 13.

The sleeve-type outer housing 14, which has a significantly larger wall thickness than the spindle bearing housing 3, extends upward to adjacent the area of a wharve 7 which is fixedly connected with the spindle shaft 2 and which is situated in the area of the bolster 4. By way of the wharve 7, a drive of the spindle shaft 2 takes place by means of a tangential belt which is not shown.

A cover 22 in the form of a ring is mounted on the spindle bearing housing 3 and reaches over the upper end of the outer housing 14 to cover the top end of the annular gap between the bearing housing 3 and outer housing 14, without contacting outer housing 14.

In the area of its upper end, the outer housing 14 is fastened to a spindle rail 20. It is provided with an external thread 16 and is fitted through a bore of the spindle rail 20. On both sides of the spindle rail 20, rings 17, 18 are arranged which, in the areas opposite one another, have a slight wobble or inclination so that, by means of a mutual twisting of these rings 17, 18, the angular position can be adjusted of the outer housing 14 and thus of the spindle bearing housing 3 with the spindle shaft 2. The outer housing 14 is held by means of a nut 19 screwed onto the external thread 16.

The pin-type projection 12 of the spindle bearing housing 3 forms a point of discontinuity 11 for structure-borne sound so that the flow of structure-borne sound from the spindle bearing housing 3 to the outer housing 14 and thus to the spindle rail 20 is largely interrupted or at least considerably reduced. In addition, the projection 12 allows an elastic deformation which takes place around an imaginary tilting axis in the area of the contraction so that the spindle bearing housing 3 in the area of the neck bearing 4 and therefore also in the area of the wharve 7 is spring-elastically flexible essentially in the radial direction. In this manner, the running noises originating from the neck bearing 4 are limited essentially to the noise radiating from the spindle bearing housing 3 which is also largely shielded off by the outer housing 14.

In contrast to the arrangement of FIG. 1 where vibrations from the prior art neck bearing are transmitted directly to the spindle rail by the fixed clamping of the bearing housing, the arrangement of the invention illustrated in FIG. 2 provides that the neck bearing vibrations must travel downward to the bottom of the bearing housing, through the discontinuity point 12 and then upward through the outer housing to the spindle rail. This configuration very advantageously reduces the sound generated at the spinning frame and rail and thus accommodates practical operations at significantly higher operating speeds.

A further reduction of noise is achieved according to certain preferred embodiments in that the space (annular gap) 21 between the spindle bearing housing 3 and the outer housing 14 surrounding it at a distance is filled with a sound insulating medium which is viscous at normal operating temperatures. The normal operating temperatures are in a range of 20° C. to 60° C. In preferred embodiments, the space 21 is filled so far that at least $\frac{2}{3}$ of the height of the spindle bearing housing 3 is covered by this sound insulating medium. In order to prevent that the medium leaks out of the space 21, it may additionally be provided in a modified embodiment that a sealing ring made of a rubber-elastic material is provided in the upper area between the spindle bearing housing 3 and the outer housing 14. As a result, it will then be possible to fill the space 21 virtually along the complete height with the viscous medium. Greases or resins which are viscous in this temperature range are suitable to be used as the medium that is viscous at the operating temperatures. Another selection criterion for the medium is that it has a relatively high wettability, i.e., largely avoids the formation of hollow spaces.

Figure 3:
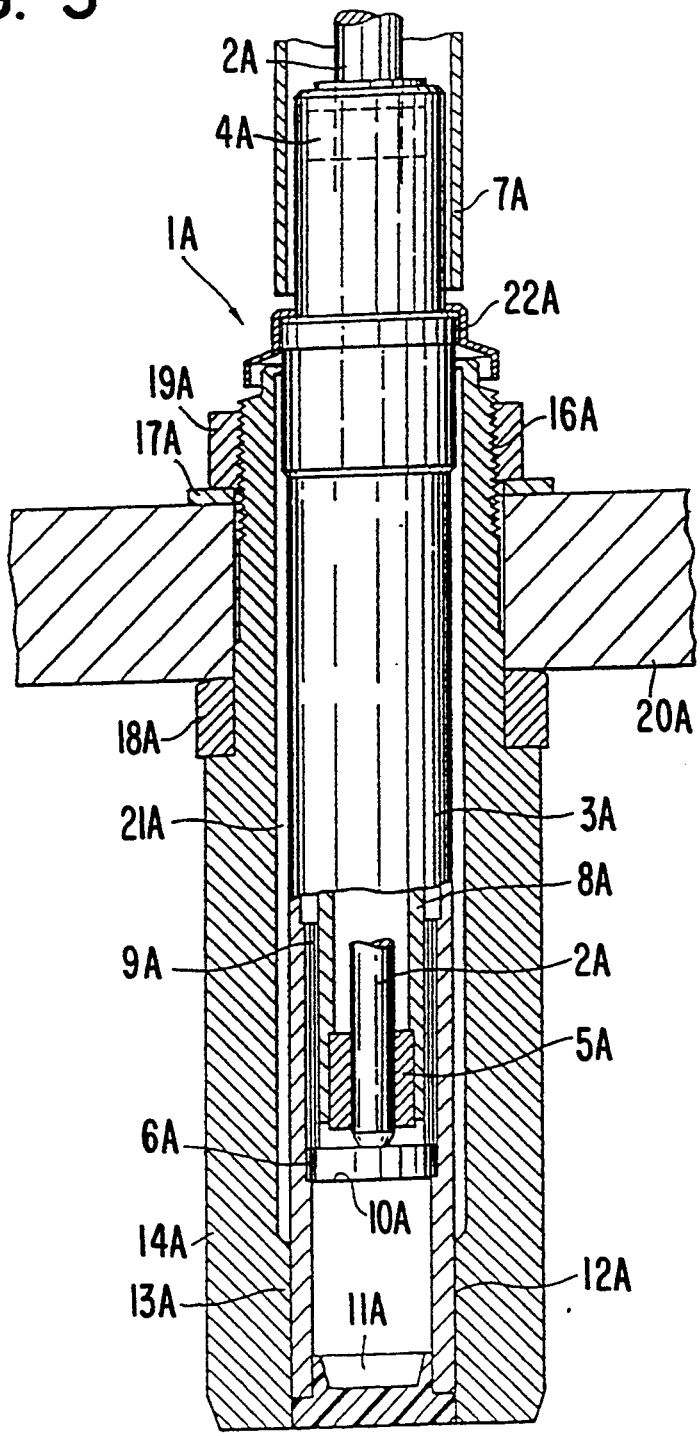
FIG. 3 is a view similar to FIG. 2, showing another preferred embodiment of the invention.

In FIG. 3 and the following description, corresponding drawing reference numbers with a suffix "A" are used to designate structure corresponding to similarly numbered structure of FIG. 2. Unless otherwise described herein, reference to the above description for FIG. 2 is to be made.

The spinning or twisting spindle assembly 1A of FIG. 3 has a spindle shaft 2A which is non-rotatably connected with a spindle top part which is not shown. By means of a neck bearing 4A and a step bearing assembly 5A, the spindle shaft 2A is disposed in a spindle bearing housing 3A which has a tube-shaped basic body with a relatively thin wall thickness. The step bearing assembly 5A comprises a bearing sleeve which is held by means of a centering sleeve 8A which, in its upper, not shown end, in the area below the neck bearing 4A, is held on the spindle bearing housing 3A. Between the spindle bearing housing 3A and the centering sleeve 8A, a damping coil 9A is also provided. The end of the spindle shaft 2A is supported against a bottom plate 6A which rests against a ring shoulder 10A of the spindle bearing housing 3A.

The neck bearing 4A, which is only outlined in FIG. 3, is constructed as a roller bearing. The roller bodies move directly on the spindle shaft 2A. On the outside, the roller bodies move against an outer ring or race of the bearing which is held in the upper part of the spindle bearing housing 3A. This upper part of the spindle bearing housing 3A, which is constructed as an insert, is constructed to be elastically flexible in the radial direction of the spindle shaft 2A. This is obtained, for example, by a weak point in the form of a surrounding ring groove.

The upper part of the spindle, which is not shown, is non-rotatably connected with a driving wharve 7A which reaches around the spindle bearing housing 3A in the area of the neck bearing 4A. The drive of the upper spindle part and thus of the spindle shaft 2A takes place by means of a tangential belt or the like moving along against the driving wharve 7A.

The spindle bearing housing 3A is lengthened in a straight line beyond the area of the ring shoulder 10A. This area, which is lengthened in a tube shape, is pressed by means of a press fit 12A, into a collar 13A of a sleeve-type outer housing 14A which, while leaving a ring gap 21A, surrounds the spindle bearing housing 3A along at least two thirds of its axial height and preferably into the area closely under the driving wharve 7A. Instead of the collar 13A on the sleeve-type outer housing 14A, a corresponding collar may also be mounted on the outside on the spindle bearing housing 3A which is constructed as a part from high-alloy steel anyhow. The lower end of the lengthened spindle bearing housing 3A is closed off by means of a stopper 11A which consists particularly of a plastic material.

The preferably cylindrical sleeve-type housing 14A is provided with a recess and an external thread 16A in the area of its upper end. In this area, it receives two rings 17A, 18A which, in turn, receive a spindle rail 20A between one another. The surfaces of the rings 17A, 18A, which are opposite one another, have a slight wobble so that, by means of a mutual twisting of the rings 17A, 18A, the angular position of the sleeve-type housing 14A can be adjusted with respect to the perpendicular line, and thus the angular position of the spindle shaft 2A can also be adjusted. A threaded ring or nut 19A is screwed onto the external thread 16A by means of which the sleeve-type housing 14A can be clamped to the spindle rail 20A.

The spindle bearing housing 3A is provided with a cup-type covering 22A which reaches around the upper edge of the sleeve-type outer housing 14A at a distance.

The sleeve-type outer housing 14A has an axial moment of inertia with respect to the axis of the spindle shaft 2A which amounts to at least 10 times the axial moment of inertia of the spindle bearing housing 3A. The axial moments of inertia are determined by a corresponding selection of material and corresponding dimensions for the sleeve-type outer housing 14 and the spindle bearing housing 3A. Preferably, the sleeve-type outer housing 14A and the spindle bearing housing 3A are made of steel. They are manufactured of a rod material by means of cutting. Basically, the use of other metallic materials, particularly aluminum or brass, is also possible. In this case, the wall thickness of the sleeve-type outer housing 14A amounts to at least 4 times the wall thickness of the spindle bearing housing 3A. The sleeve-type outer housing 14A is therefore much stiffer than the spindle bearing housing 3A. As a result, it is achieved that the spindle bearing housing 3A can hardly excite the sleeve-type housing 14A to perform vibrations during operating conditions in practice, for example, also at rotational speeds of 20,000 revolution per minute ($min^{-1}$). Therefore the structure-borne sound flow between the spindle bearing housing 3A and the sleeve-type housing 14A is largely prevented. Because the sleeve-type housing 14A, in addition, has a relatively large wall thickness and covers the spindle bearing housing 3A largely along its axial height, a shielding of noise toward the outside is also obtained with respect to the sound generated by the spindle bearing housing 3A. This shielding is completed by the covering 22A.

By means of the construction according to the embodiment of FIG. 3, it is possible to keep the running noises of the spinning or twisting spindle within reasonable limits without the requirement of arranging rubber-elastic damping devices between the spinning or twisting spindle 1A and the spindle rail 20A. Although rubber-elastic damping devices of this type reduce noise, they have the disadvantage that, because of these devices, the position of the spinning or twisting spindle 1A is no longer determined precisely.

Figure 4:
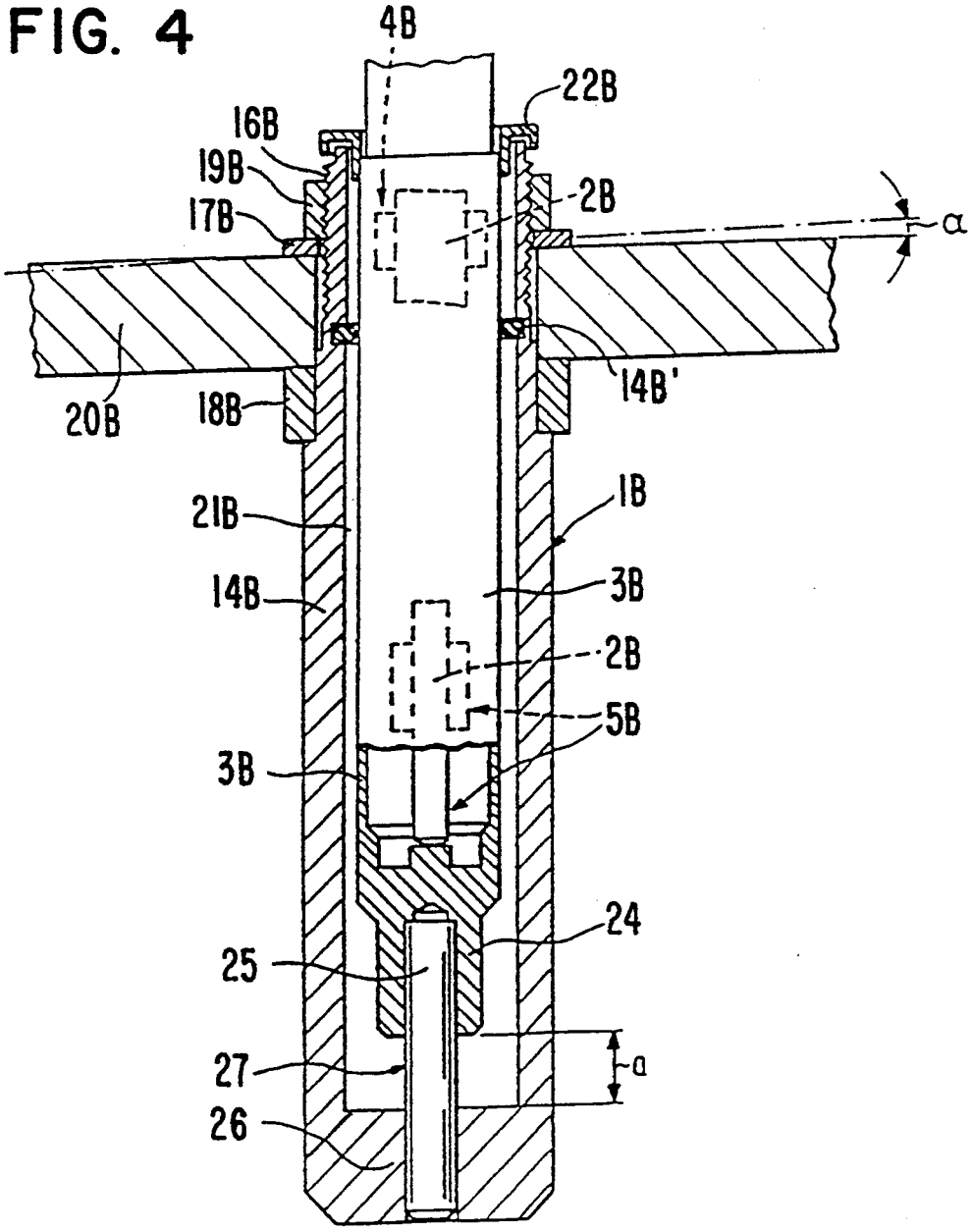
FIG. 4 is a view similar to FIG. 2, showing another preferred embodiment of the invention.

In FIG. 4 and the following description, corresponding drawing reference numerals with a suffix "B" are used to designate structure corresponding to similarly numbered structure of FIG. 2. Unless otherwise described herein, reference to the above description of FIG. 2 is to be made.

The spinning or twisting spindle assembly 1B shown in FIG. 4 is arranged vertically in a conventional manner and has a spindle shaft 2B which is disposed in a spindle bearing housing 3B by means of a neck bearing 4B and a step bearing assembly 5B. The neck bearing 4B and the step bearing assembly 5B are constructed in a known manner. The neck bearing 4B is constructed as a roller bearing, the rollers of which run directly on the spindle shaft 2 on the inside and, on the outside, run on an outer ring of the bearing which is inserted into the spindle bearing housing 3A. The step bearing assembly 5A is constructed in two parts. It has a bearing bush or sleeve which is used for the radial bearing and, in a manner not shown in detail, is held by a centering sleeve (compare sleeve 8 of FIG. 2) housed in the interior of the bearing housing 3B. The end of the spindle shaft 2B supports itself in the axial direction on a pivot bearing which is formed, for example, by the bottom section 24 of the bearing housing 3B. This bottom 24 is constructed in one piece with the bearing housing 3B. However, it may also be an insert inserted into the bearing housing 3B according to other contemplated embodiments.

As an axial extension of the spindle bearing housing 3B, a pin 25 is pressed into the bottom 24 provided with an axial bore. The pin 25 serves as a connecting element between the spindle bearing housing 3B and outer housing 14B which surrounds the spindle bearing housing 3B at a distance so that a surrounding toroidal chamber or gap 21B remains. The pin 25, with its end facing away from the bottom 24 of the spindle bearing housing 3B is pressed into the bottom 26 of the housing 14B. In this case, a free length (a) of the pin 25 exists between the spindle bearing housing 3B, that is, its bottom 24, and the surrounding housing 14B, that is, its bottom 26.

The housing 14B surrounding the spindle bearing housing 3B is fastened to a spindle rail 20B in the area of its upper end, that is, in the area of the neck bearing 4B. Two ring disks 17B, 18B which accommodate the spindle rail 20B between them are arranged between a nut 19B screwed onto an external thread 16B of the housing 14B and a ring collar. The front faces of the ring disks 17B, 18B which face one another deviate by a small angle with respect to the radial to the spindle axis. As a result, it is possible to adjust the whole spinning or twisting spindle 1B in the slope with respect to the perpendicular line by the mutual turning of the ring disks 17B, 18B. A cover 22B is fastened to the spindle bearing housing 3B which reaches around the upper end of the outer housing 14B and which shields the direct emerging of sound from the area of the neck bearing 4B in the upward direction. A sealing ring 14B', such as an O-ring, is inserted into a ring groove of the outer housing 14B and seals off the annular chamber 21 toward the outside. At the spindle shaft 2B, a driving wharve is fastened in a known manner (see wharve 7 of FIG. 2), a tangential belt driving the spindle shaft moving against the driving wharve. In an embodiment that is modified with respect to FIG. 4, it is provided that the driving wharve which is nonrotatably connected with the spindle shaft reaches around the neck bearing 4B. In this case, it is provided that the housing 14B is shortened in its height so that the area of the neck bearing 4B comes to be situated above the spindle rail 21B (compare FIGS. 2 and 3).

As illustrated in FIG. 4, the spindle bearing housing 3 is fastened with respect to the spindle rail 20B only by way of the pin 25 inserted into its bottom and by way of this pin 25 is fastened to the spindle rail 20B by means of the closed outer housing 14B surrounding the spindle bearing housing 3B. As mentioned above, the neck bearing 4B is the significant source of the running noises of a spinning or twisting spindle of this type. The roll-off movements of the neck bearing 4B lead to vibrations of the bearing housing 3B which cause the generating of noise. These noises which otherwise would radiate from the bearing housing 3B are now largely shielded off because of the surrounding housing 14B.

In order to further reduce the radiating of noise from the spindle bearing housing 3B and to affect its natural-vibration characteristics, it is coated with plastic on the outside. Furthermore, the transmission of vibrations of the spindle-bearing housing 3B to the housing 14B and the spindle rail 20B is largely reduced so that the overall generating of noise is significantly reduced. Tests have shown that a noise reduction of from 5 to 6 db(A) could be reached in the case of one group of spindles. The flow of structure-borne sound from the spindle bearing housing 3B to the spindle rail 20B is reduced by providing a point of discontinuity 27 in the area of the pin 25. This point of discontinuity 27 in the area of the free length (a) of the pin 25 has a first discontinuity in the area of the transition from the bottom of the spindle bearing housing 3B to the pin 25 and a second discontinuity in the area of the transition from the pin 25 to the bottom 26 of the surrounding outer housing 14B.

The first discontinuity is obtained essentially by different material cross-sections between the bottom 24 of bearing housing 3B and the pin 25, in which case the material cross-section of the pin 25 should be approximately in the order of half the material cross-section of this bottom 24. The second discontinuity, on the one hand, is also obtained by means of different material cross-sections, that is, differences in the material cross-sections of the pin 25 and of the bottom 26, the bottom 26 of the housing 14B having a material cross-section that is twice or several times that of the pin 25. In addition, this discontinuity is improved by the fact that the housing 14B and the pin 25 are made of materials with a very different modulus of elasticity. The pin 25 consists of a high-yield-point spring steel with a correspondingly high modulus of elasticity. 0n the other hand, the housing 14B is preferably made of gray cast iron and therefore has a much lower modulus of elasticity. During the mentioned practical tests, the good results were achieved by means of a pin 25 which had a free length (a) of from 2 to 8 mm and a diameter of 6 mm. In this case, it is also advantageous for the wall thickness of the housing 14B to be many times that of the thickness of the wall 6 of the bearing housing 3B; in the case of the embodiment of FIG. 4, approximately 4 to 5 times that of the thickness of the wall of the bearing housing 3B.

On the whole, the spindle rail 20B may be slanted by a small angle ($\alpha$) toward the operating side in order to compensate elastic deformations of the spindle as a result of the belt pressure. Expediently, the spindle rail 20B is held in the machine frame in such a manner that the slanting is adjustable.

FIGS. 5-9 which show alternative embodiments, corresponding generally to the FIG. 4 embodiment except for the illustrated interconnection between the bottom of the bearing housing and the outer housing.

Figure 5:
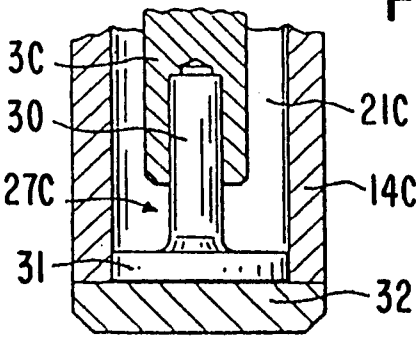

In principle, the embodiment according to FIG. 5 is constructed corresponding to the embodiment according to FIG. 4. Corresponding reference numerals with a suffix "C" are used for corresponding numbered structure of FIG. 4. A pin 30 is pressed into the bottom of the spindle bearing housing 3C, with its free length projecting out of the bottom, and subsequently is provided with a flange 31. By means of this flange 31, the pin 30 is pressed into the outer housing 14C which, in the manner of a sleeve, surrounds the spindle bearing housing 3C, only the bottom of which is shown. In the downward direction, the housing 14C is closed off by a bottom 32 which is screwed or welded to the outer housing 14C.

Figure 6:
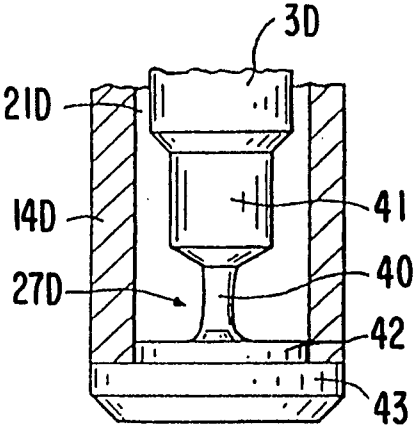

In principle, the embodiment according to FIG. 6 also corresponds to the embodiment according to FIG. 4. Corresponding reference numerals with a suffix "D" are used for corresponding numbered structure of FIG. 4. In this embodiment, the point of discontinuity is formed by a pin-type part 40 which is formed in one piece to the bottom 41 of the spindle bearing housing 3D which, in turn, is also manufactured in one piece with the sleeve-shaped part situated above it. A high-yield-point machining steel is expediently provided as the material. The pin-shaped part 40 merges into a flange 42 pressed into the end of the housing 14D. In this embodiment, the flange 42, also in one piece, is constructed to be supported with a bottom 43 which closes off the housing 14D. The bottom 43 is welded together with the housing 14D.

Figure 7:
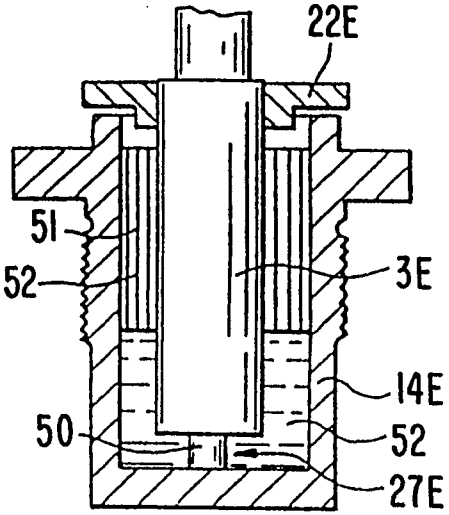
FIGS. 5 to 9 are respective partial views showing bottom portions of bearing housings and outer housings connected to one another according to preferred embodiments of the invention.

In the embodiment of FIG. 7, corresponding reference numerals with a suffix "E" are used for corresponding numbered structure of FIG. 4. Also in the embodiment according to FIG. 7, the spindle bearing housing 3E, by way of a pin 50 forming a point of discontinuity 27E, is fastened to the bottom of outer housing 14E surrounding the spindle bearing housing 3E. A damping coil 51 is arranged between the spindle bearing housing 3E and the interior wall of the surrounding outer housing 14E. In this embodiment, a grease 52 is filled in as the damping medium between the surrounding housing 14E and the spindle bearing housing 3E.

Figure 8:
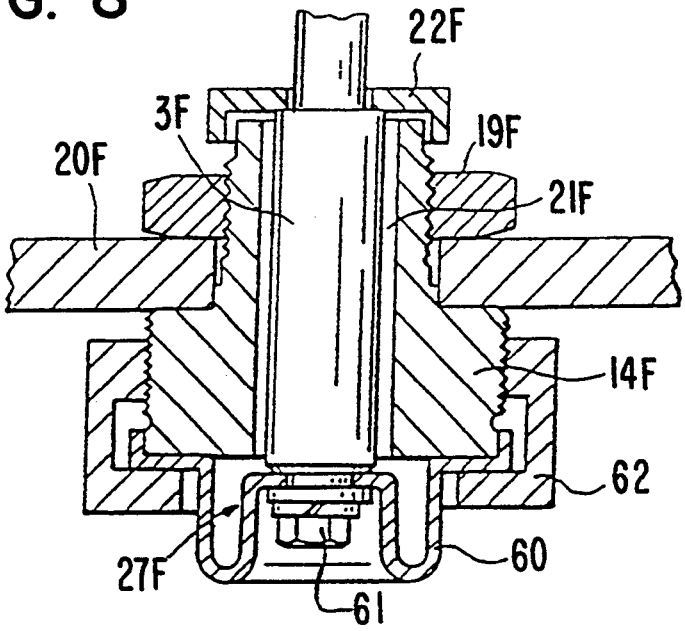

In the embodiment of FIG. 8, corresponding reference numerals with a suffix "F" are used for corresponding numbered structure of FIG. 4. Also in the embodiment according to FIG. 8, a point of discontinuity 27F is provided between a spindle bearing housing 3F and an outer housing 14F surrounding it at a distance while leaving an annular chamber 21F. This point of discontinuity 27F is situated between the lower end of the spindle bearing housing 3F and the lower end of the outer housing 14F. The connection between the spindle bearing housing 3F and the surrounding outer housing 14F takes place by way of a cup-shaped spring element 60 which is mounted on the bottom of the spindle bearing housing 3F in a central flat area, by means of a screw 61. This central area is surrounded by a torus-type area which changes into a flange area which reaches around the lower edge of the outer housing 14F by means of its edges. The flange-type area is fastened to the lower end of the outer housing 14F by means of a screw cap 62. The spring element 60 therefore forms the bottom of the sleeve-shaped outer housing 14F. The outer housing 14F is fitted from below through a spindle rail 20F and is secured by means of a nut 19F screwed onto an external thread of the housing 14F. In the upward direction, the housing 14F is closed off by a cover 22F which is fastened to the spindle bearing housing 3F.

Figure 9:
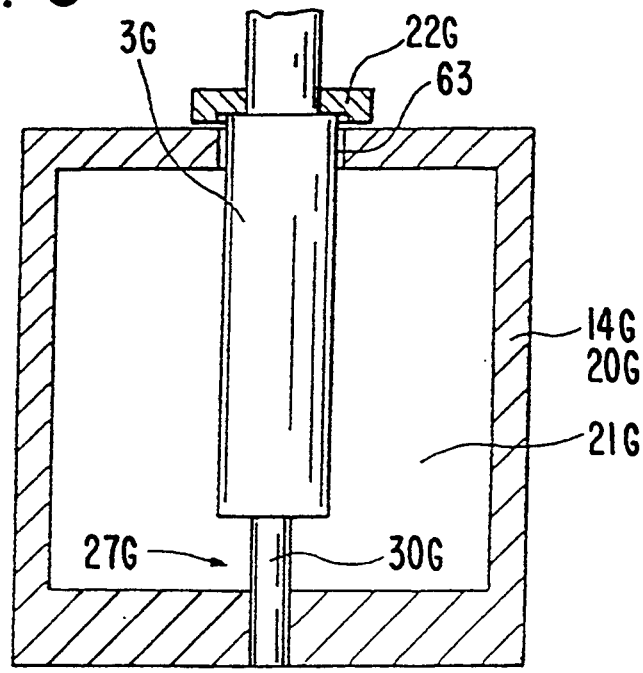

In the embodiment of FIG. 9, corresponding reference numerals with a suffix "G" are used for corresponding numbered structure of FIG. 4. Also in the embodiment according to FIG. 9, it is provided that the spindle bearing housing 3G is fastened to a spindle rail 20G by way of a point of discontinuity 27G which is formed essentially by a pin 30G. The spindle rail 20G has a tube-shaped profile so that, in the manner of a duct, it surrounds several bearing housings of spinning or twist spindles which are arranged in a row behind one another. The pin 30G which is mounted to the bottom of the spindle bearing housing 3G in the above-described manner, for example, according to FIG. 4, is fastened to the bottom of the spindle rail 20G. The spindle bearing housing 3G projects through a bore 63 of the top side toward the outside which maintains a sufficient radial distance with respect to the spindle bearing housing 3G. This bore 63 is covered by means of a cover 22G mounted on the spindle bearing housing 3G.

It is pointed out again that in all practical illustrated preferred embodiments in which a drive is provided by means of a belt, the spindle bearing housing projects upwardly beyond the surrounding outer housing so that the neck bearing is situated outside the outer housing. As a rule a driving wharve will then be situated in the area of the neck bearing which reaches around the spindle bearing housing and which is nonrotatably connected with the spindle shaft.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning or twisting spindle bearing assembly for supporting a spinning or twisting spindle shaft, comprising:

a spindle shaft neck bearing engageable with a spindle shaft at a first axial location thereof and serving to radially support the spindle shaft, a spindle shaft step bearing for radially and axially supporting an end portion of the spindle shaft at a location spaced axially of the first axial location, a spindle bearing housing enclosing the neck bearing and step bearing, an outer housing surrounding the spindle bearing housing with a radial spacing between the spindle bearing housing and outer housing forming an annular gap which extends from adjacent the location of the step bearing along a substantial portion of the axial length of the spindle bearing housing, said bearing housing being closed to prevent flow of lubricant fluid between the interior of the bearing housing to the annular gap, connecting structure for connecting the outer housing directly to a spinning machine frame member at an axial location of the spindle shaft which is axially spaced from the spindle shaft step bearing, wherein the annular gap between the outer housing and the spindle bearing housing extends from the connecting structure over substantially the entire remaining length of the outer housing, and a vibration isolation connection of the outer housing and bearing housing located axially spaced from the neck bearing and from the machine frame member, such that vibrations experienced in use at the neck bearing are transmitted indirectly to the machine frame member substantially only by way of the bearing housing to the vibration isolation connection and then through the outer housing to the machine frame member.

2. An assembly according to claim 1, wherein said connecting structure for connecting the outer housing directly to a spinning machine frame member is disposed at an axial location intermediate the first axial location of the neck bearing and the location of the step bearing.

3. An assembly according to claim 1, wherein the vibration isolation connection is a metallic connection.

4. An assembly according to claim 1, wherein the vibration isolation connection is more elastic than are the spindle bearing housing and outer housing structure connected thereby.

5. An assembly according to claim 1, wherein the neck bearing is disposed above the step bearing when in an in-use position supporting a spindle shaft, wherein the outer housing terminates in the upward direction below the top of the bearing housing, and wherein the bearing housing is provided with an annular cap which is spaced from the outer housing and covers the annular gap between the bearing housing and outer housing from above.

6. An assembly according to claim 1, wherein the vibration isolation connection includes a metallic connection element between a bottom part of the bearing housing and the outer housing, said metallic connection being provided with a diminished cross-section as compared to the bottom part of the bearing housing which defines a section which is spring-elastically flexible when subjected to bending forces, wherein the diminished cross-section of the connecting element is constructed as a discontinuity point which limits the transmission of structure-borne sound and which has a spring rate of 70 N/mm to 300 N/mm with respect to the flexural strength in the case of a radial load at the neck bearing, and wherein a sound dampening medium with a sound velocity of less than 500 m/s is present between the spindle bearing housing and the outer housing.

7. An assembly according to claim 6, wherein the connecting element is manufactured in one piece with the spindle bearing housing.

8. An assembly according to claim 6, wherein the area of the diminished cross-section has at least approximately the shape of a pin the length of which is larger than its diameter.

9. An assembly according to claim 6, wherein the sound dampening medium is grease which fills the outer housing from its bottom up to a position adjacent at least surrounding the connecting element and a lower part of the bearing housing.

10. An assembly according to claim 6, wherein the sound dampening medium is an elastomer which fills the outer housing from its bottom up to a position adjacent at least surrounding the connecting elements and a lower part of the bearing housing.

11. An assembly according to claim 6, wherein the outer housing has a higher axial moment of inertia than the spindle bearing housing.

12. An assembly according to claim 1, wherein the outer housing has a higher axial moment of inertia than the spindle bearing housing.

13. An assembly according to claim 1, wherein said outer housing exhibits an axial moment of inertia which is at least ten times the axial moment of inertia of the spindle bearing housing.

14. An assembly according to claim 1, wherein said outer housing extends at least along two thirds of the height of the spindle bearing housing.

15. An assembly according to claim 1, wherein a sound dampening medium is filled into the annular gap between the outer housing and the bearing housing to a level at least two-thirds of the height of the spindle bearing housing.

16. An assembly according to claim 15, wherein the bearing housing is filled with lubricating oil to a level at least covering the step bearing, and wherein said lubricating oil is of different material than is said sound dampening medium.

17. An assembly according to claim 15, wherein said sound dampening medium is a medium which is viscous in a temperature range between 20° C. and 60° C.

18. An assembly according to claim 1, wherein said neck bearing is disposed vertically above the step bearing, and wherein the vibration isolation connection is located below the step bearing.

19. An assembly according to claim 1, wherein the vibration isolation connection includes a pin member press fit into a bottom exterior part of the bearing housing and into a bottom interior part of the outer housing.

20. An assembly according to claim 19, wherein said pin is formed of different material than the material of at least one of the bearing housing and the outer housing.

* * * * *